US011953224B2

(12) United States Patent
Zhu et al.

(10) Patent No.: US 11,953,224 B2
(45) Date of Patent: Apr. 9, 2024

(54) DEVICE FOR AUTOMATIC CONTROL OF TEMPERATURE, SYSTEM FOR AUTOMATIC CONTROL OF TEMPERATURE, AND METHOD THEREOF

(71) Applicant: TRIPLE WIN TECHNOLOGY(SHENZHEN) CO. LTD., Shenzhen (CN)

(72) Inventors: Qi-Qi Zhu, Wuhan (CN); Yu-Tsang Tu, New Taipei (TW); Yen-Sheng Lin, New Taipei (TW); Ying-Quan Zhao, Shenzhen (CN)

(73) Assignee: TRIPLE WIN TECHNOLOGY(SHENZHEN) CO.LTD., Shenzhen (CN)

( * ) Notice: Subject to any disclaimer, the term of this patent is extended or adjusted under 35 U.S.C. 154(b) by 231 days.

(21) Appl. No.: 17/674,083

(22) Filed: Feb. 17, 2022

(65) Prior Publication Data

US 2023/0067050 A1 Mar. 2, 2023

(30) Foreign Application Priority Data

Aug. 25, 2021 (CN) ..... 202110981959.8

(51) Int. Cl.
*F24F 11/76* (2018.01)
*F24F 3/00* (2006.01)
*F24F 13/12* (2006.01)

(52) U.S. Cl.
CPC ..... *F24F 11/76* (2018.01); *F24F 3/00* (2013.01); *F24F 13/12* (2013.01)

(58) Field of Classification Search
CPC .... F24F 11/76; F24F 2003/0446; F24F 3/048; F24F 13/12; F16K 3/0281; F16K 31/04
See application file for complete search history.

(56) References Cited

U.S. PATENT DOCUMENTS 5,851,143 A * 12/1998 Hamid ..... G01R 31/2849
2005/0208888 A1* 9/2005 Moore ..... F24F 11/76 454/334
2016/0330285 A1* 11/2016 Brophy ..... F24F 11/62
2019/0323142 A1* 10/2019 Huang ..... H01L 21/02068

FOREIGN PATENT DOCUMENTS

CN 106944449 A 7/2017
CN 112023988 A 12/2020

* cited by examiner

*Primary Examiner* — Schyler S Sanks
(74) *Attorney, Agent, or Firm* — ScienBiziP, P.C.

(57) ABSTRACT

A device providing automatic control of temperature for an environment of a working station includes an air box, a baffle member, and a driving assembly. The air box is coupled to a machine defining a working space which the working station is in. The air box defines an opening. The opening allows cooling air to be introduced into the working space. The baffle member is slidably coupled to the air box at the opening. The driving assembly coupled to the baffle member drives the baffle member to cover the opening completely, to cover the opening partially, or to leave the opening uncovered in accordance with a difference between a current temperature of the working space and a desired target temperature of the working space. A related system and method are also disclosed.

16 Claims, 6 Drawing Sheets

DEVICE FOR AUTOMATIC CONTROL OF TEMPERATURE, SYSTEM FOR AUTOMATIC CONTROL OF TEMPERATURE, AND METHOD THEREOF

FIELD

The subject matter herein generally relates to temperature control technology, and particularly to a device for automatic control of temperature, and a system for automatic control of temperature, and a method thereof.

BACKGROUND

In some working spaces, environmental temperatures must be kept in a desired temperature range. A common way is to introduce cooling air into the working space, and exhaust hot air from the working space. To control a speed of introducing the cooling air, a valve can be arranged in an inlet tube to adjust a size of input, thus a controlled effect of temperature of the working space can be achieved.

However, to adjust a temperature in a working space, an operator firstly needs to detect a current temperature of the working space and then operate a valve manually to adjust the temperature according to a different value between the current temperature and a desired target temperature of the working space. Thus, a problem of inconvenience to an operator may be present and the control accuracy may be low.

SUMMARY

An embodiment of the present application provides a device for automatic control of temperature, a system for automatic control of temperature, and a method thereof capable of controlling a size of an air inlet opening according to a result of testing a temperature of a working space and a desired target temperature of the working space, thus improving the accuracy in controlling temperature.

An embodiment of the present application provides a device for automatically controlling an environmental temperature of a working station. The device includes an air box, a baffle member, and a driving assembly. The air box is coupled to a machine defining a working space where the working station is located. The air box defines at least one opening. The at least one opening is configured to provide an opening for cooling air to be introduced into the working space. The baffle member is slidably coupled to the air box at the opening. The driving assembly is coupled to the baffle member. The driving assembly can drive the baffle member to cover the opening completely, to cover the opening partially, or to not cover the opening via a difference between a current temperature of the working space and a desired target temperature of the working space.

According to some embodiments of the present application, the driving assembly includes a motor, a plurality of synchronous gears, and a synchronous belt. The motor is fixed to one of the synchronous gears. The synchronous belt is wound around the synchronous gears. The baffle member is coupled to one side of the synchronous belt. The motor is operatively to drive the synchronous belt to bring the baffle member to cover the opening completely, to cover the opening partially, or to not cover the opening.

According to some embodiments of the present application, the device further includes a guiding assembly. The guiding assembly includes a sliding rail and a sliding block. The sliding block is slidably coupled to the sliding rail. The sliding block is coupled to the baffle member, and the baffle member is coupled to the one side of the synchronous belt via the sliding block.

According to some embodiments of the present application, the device includes a structural base. The structural base includes a first plate and a second plate. The first plate is configured to fixed to the machine. The second plate is fixed to the first plate. The motor and the sliding rail are fixed to opposite surfaces of the second plate, the synchronous gears and the synchronous belt are arranged at the same side of the second plate. One synchronous gear is fixed to an output shaft of the motor, the other synchronous gear is rotatably coupled to the second plate.

According to some embodiments of the present application, the at least one opening is an air inlet opening and an air outlet opening. The baffle member is slidably coupled to the air box at the air inlet opening or the air outlet opening.

According to some embodiments of the present application, the device further includes a position detection unit. The position detection unit is configured to detect a current position of the baffle member. The driving assembly is operatively to drive the baffle member to cover the opening completely, to cover the opening partially, or to not cover the opening via a difference between the current position of the baffle member and one of target positions of the baffle member corresponding to the desired target temperature of the working space. Each of the target positions of the baffle member corresponds to one of the target temperatures of the working space.

According to some embodiments of the present application, the air box includes a casing and a first connecting member. The opening is defined in the casing. The first connecting member is coupled to the casing at the opening. A sliding groove is defined in the casing or the first connecting member. The sliding groove communicates with the opening. The baffle member is slidably coupled to the air box at the sliding groove.

According to some embodiments of the present application, the baffle member extending outside of the sliding groove defines a retreating gap. The retreating gap is configured to receive a sidewall of the casing forming the sliding groove or a sidewall of the first connecting member forming the sliding groove.

An embodiment of the present application provides a system for automatically controlling an environmental temperature of a working station. The system includes an air box, a baffle member, a driving assembly, a temperature detection unit, and a control device. The air box is coupled to a machine defining a working space where the working station is located. The air box defines at least one opening. The at least one opening is configured to provide an opening for cooling air to be introduced into the working space. The baffle member is slidably coupled to the air box at the opening. The driving assembly is coupled to the baffle member. The temperature detection unit is configured to detect a current temperature of the working space. The control device is coupled to the driving assembly and the temperature detection unit. The control device is configured to control the driving assembly to drive the baffle member to cover the opening completely, to cover the opening partially, or to not cover the opening via a difference between a current temperature of the working space detected by the temperature detection unit and a desired target temperature of the working space.

According to some embodiments of the present application, the driving assembly includes a motor, a plurality of synchronous gears, and a synchronous belt. The motor is fixed to one of the synchronous gears. The synchronous belt is wound around the synchronous gears. The baffle member is coupled to one side of the synchronous belt. The control device is configured to output a movement triggering signal to the motor to drive the synchronous belt to bring the baffle member to cover the opening completely, to cover the opening partially, or to not cover the opening.

According to some embodiments of the present application, the system further includes a guiding assembly. The guiding assembly includes a sliding rail and a sliding block. The sliding block is slidably coupled to the sliding rail. The sliding block is coupled to the baffle member, and the baffle member is coupled to the one side of the synchronous belt via the sliding block.

According to some embodiments of the present application, the system includes a structural base. The structural base includes a first plate and a second plate. The first plate is configured to fixed to the machine. The second plate is fixed to the first plate. The motor and the sliding rail are fixed to opposite surfaces of the second plate, the synchronous gears and the synchronous belt are arranged at the same side of the second plate. One synchronous gear is fixed to an output shaft of the motor, the other synchronous gear is rotatably coupled to the second plate.

According to some embodiments of the present application, the system further includes a position detection unit. The position detection unit is configured to detect a current position of the baffle member, the motor is configured to control the driving assembly to drive the baffle member to cover the opening completely, to cover the opening partially, or to not cover the opening via a difference between the current position of the baffle member and one of target positions of the baffle member corresponding to the desired target temperature of the working space. Each one of the target positions of the baffle member corresponds to one target temperature of the working space.

According to some embodiments of the present application, the air box includes a casing and a first connecting member. The opening is defined in the casing. The first connecting member is coupled to the casing at the opening. A sliding groove is defined in the casing or the first connecting member. The sliding groove communicates with the opening. The baffle member is slidably coupled to the air box at the sliding groove.

According to some embodiments of the present application, the baffle member extending outside of the sliding groove defines a retreating gap. The retreating gap is configured to receive a sidewall of the casing forming the sliding groove or a sidewall of the first connecting member forming the sliding groove.

According to some embodiments of the present application, the system further includes an interactive system. The interactive system is configured to provide an interface between an operator and the system. The interactive system is configured to display a current temperature column and a current position column, where the current temperature of the working space is displayed in the current temperature column, and the current position of the baffle member is displayed in the current position column.

An embodiment of the present application provides a method for automatically controlling an environmental temperature of a working station. The method is applied in the system. The method includes obtaining the desired target temperature of the working space; obtaining the current temperature of the working space where the working station is located from the temperature detection unit of the system; controlling the driving assembly of the system to drive the baffle member of the system to cover an opening of the system completely, to cover the opening partially, or to not cover the opening via a difference between the current temperature of the working space detected by the temperature detection unit and the desired target temperature of the working space.

According to some embodiments of the present application, the method further includes obtaining a current position of a sliding block of the system from a position detection unit of the system; determining whether the sliding block has moved to a required target position of the sliding block corresponding to the desired target temperature information according to the current position of the sliding block and the target position of the sliding block, where each target position of the sliding block corresponds to one target temperature information; outputting adjustment information to the driving assembly to bring the sliding block to move toward the target position of the sliding block corresponding to the target temperature information continuously according to the current position of the sliding block and the target position of the sliding block if the sliding block has not already moved to the target position of the sliding block.

According to some embodiments of the present application, the method may further includes checking and confirming a current position of the sliding block from the position detection unit; determining whether the sliding block has moved to the target position of the sliding block again according to the current position of the sliding block obtained again and the target position of the sliding block; continuously outputting the adjustment information to the driving assembly and determining whether the sliding block has moved to the target position of the sliding block until the sliding block has already moved to the target position of the sliding block, if the sliding block has not already moved to the target position of the sliding block.

According to some embodiments of the present application, the method further includes continuously obtaining a current temperature of the working space where the working station is located from the temperature detection unit and controls the driving assembly to drive the baffle member via a difference between the current temperature of the working space obtained again and the target temperature of the working space if the sliding block has not moved to the target position of the sliding block.

The device, the system, and the method do not need to be operated by a user, and the accuracy of controlling temperature can be improved.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Implementations of the disclosure will now be described, by way of embodiments only, with reference to the drawings. The disclosure is illustrative only, and changes may be made in the detail within the principles of the present disclosure. It will, therefore, be appreciated that the embodiments may be modified within the scope of the claims.

In addition, it should be understood that in the description of this application, terms such as "first" and "second" are used only for distinguishing in the description, but are not intended to indicate or imply relative importance or an order. The terms "exemplary" and/or "example" are used herein to mean "serving as an example, instance, or illustration." Any embodiment described herein as "exemplary" and/or "example" is not necessarily to be construed as preferred or advantageous over other embodiments. A feature that limited by "first", "second" may expressly or implicitly include at least one of the features. Use of the word "exemplary" is intended as a presentation of concepts and techniques in a concrete fashion.

Figure 1:
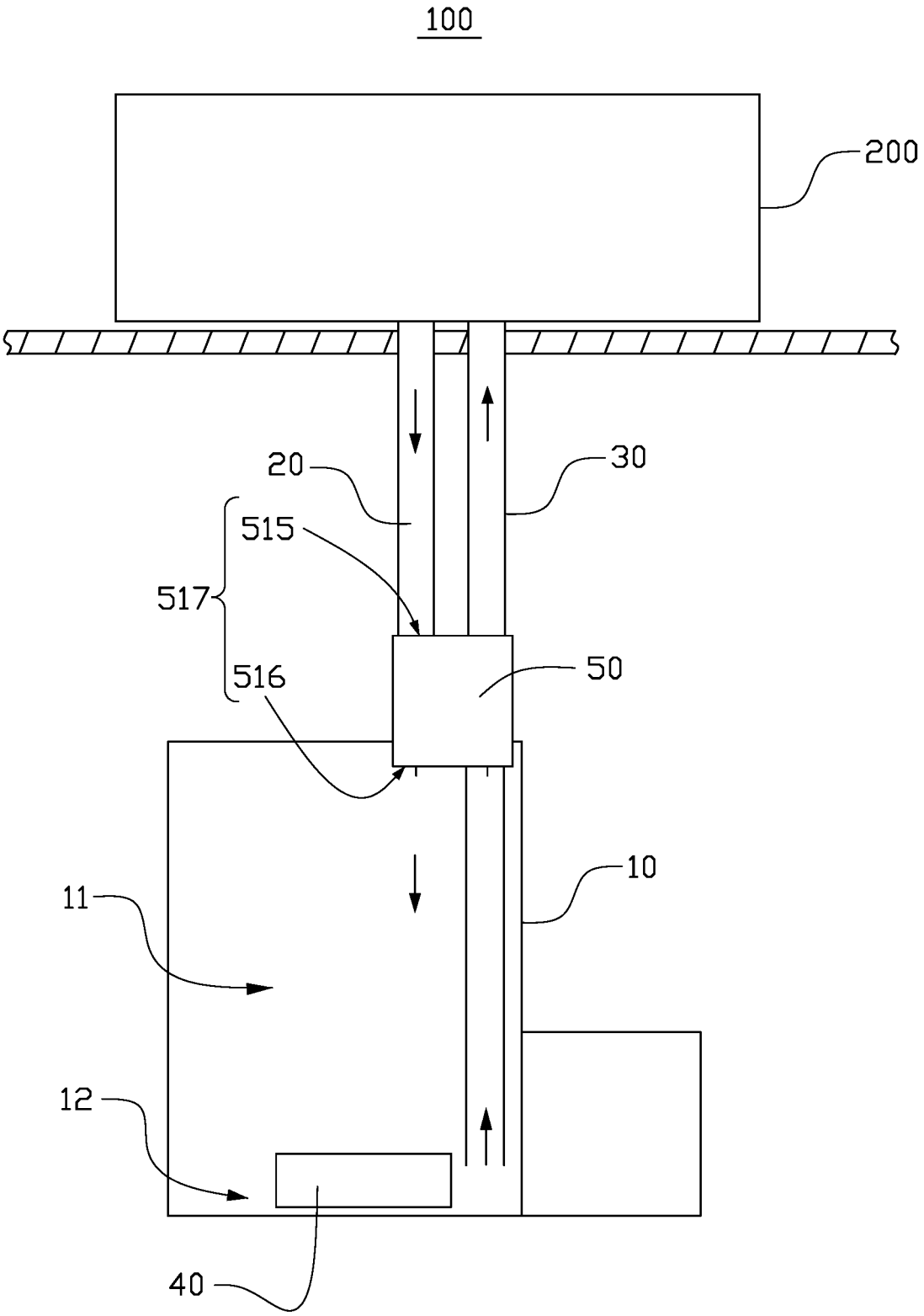
FIG. 1 is a schematic view of an embodiment of a system for automatic control of temperature.

FIG. 1 is a schematic view of an embodiment of a system for automatic control of temperature 100. The system for automatic control of temperature 100 can be configured to provide a working environment for various purposes.

The system 100 can include a machine 10, an air inlet tube 20, and an air outlet tube 30. The machine 10 can include an inner working space 11 used in production of a product or in testing the product. The machine 10 is coupled to the air inlet tube 20 and the air outlet tube 30. The working space 11 communicates with the air inlet tube 20 and the air outlet tube 30. The air inlet tube 20 and the air outlet tube 30 each is coupled to an air-conditioning system 200. The air-conditioning system 200 introduces cooling air into the working space 11 via the air inlet tube 20, and exhausts hot air from the working space 11 via the air outlet tube 30.

In some embodiments, a working station 12 can be arranged on a bottom wall inside the machine 10 forming the working space 11. The production of a product or the test of the product can be operated on the working station 12. The system 100 can include a temperature detection unit 40. The temperature detection unit 40 can be arranged in the machine 10.

In some embodiments, the temperature detection unit 40 can be arranged on the working station 12, or can be arranged on an inner wall forming the working space 11, to detect an environmental temperature of the working station 12, the disclosure is not limited herein.

In some embodiments, one or more pre-tested or pre-produced products can be arranged on the working station 12, or one or more pre-tested or pre-produced semi-finished products produced continuously can be arranged on the working station 12.

In some embodiments, one or more fixtures are installed for limiting movements of the one or more pre-tested or pre-produced products or one or more pre-tested or pre-produced semi-finished products. The temperature detection unit 40 can be arranged on the fixtures.

It can be understood that the temperature detection unit 40 can be a device capable of detecting temperature. In some embodiments, the temperature detection unit 40 can be a device capable of further outputting different electrical signals according to different temperatures. The temperature detection unit 40 can be, but is not limited to, a temperature sensor.

In some embodiments, the system 100 can further include a device for automatic control of temperature 50. The device 50 can be arranged on the machine 10. In some embodiments, the device 50 can be arranged among the machine 10, the air inlet tube 20, and the air outlet tube 30. The cooling air in the air inlet tube 20 is introduced into the working space 11 via the device 50, and the hot air in the working space 11 is exhausted into the air outlet tube 30 via the device 50. The device 50 can block completely, block partially, or not block the flow of the cooling air from the air inlet tube 20, to adjust the temperature of the working space 11. Thus, the temperature of the working station 12 can be adjusted as needed.

Figure 2A:
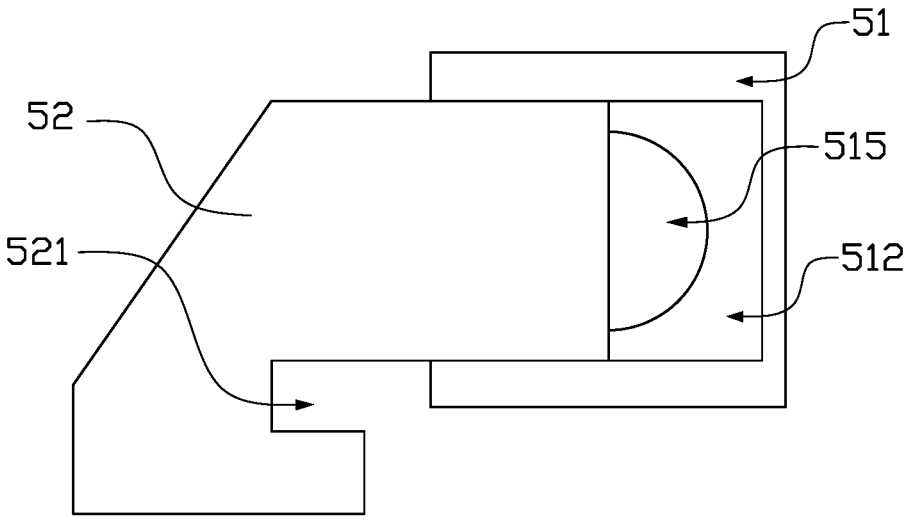
FIG. 2A is a schematic view showing an air inlet opening partly covered by a baffle member.
Figure 2B:
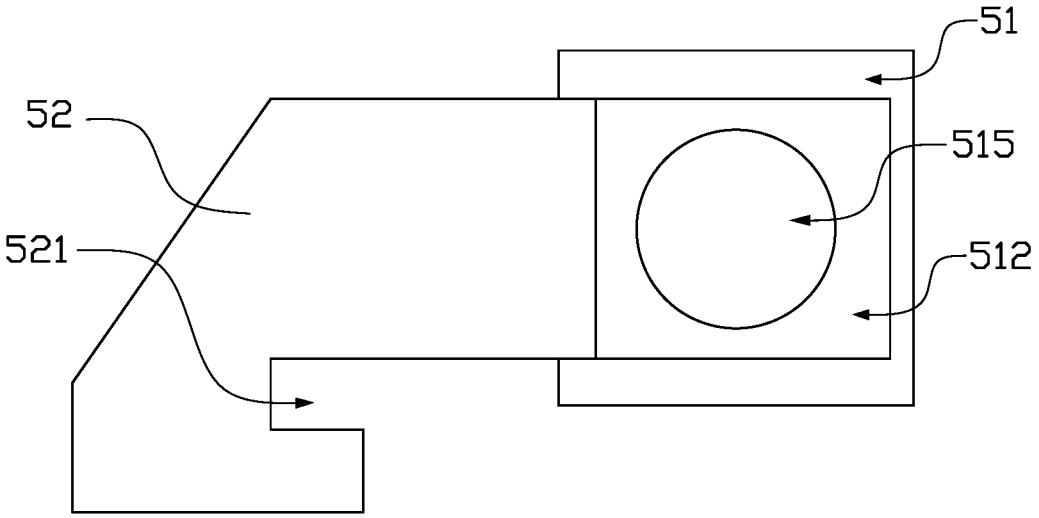
FIG. 2B is a schematic view showing the air inlet opening uncovered by the baffle member.

Referring also to FIG. 2A and FIG. 2B, in some embodiments, the device 50 can include an air box 51 and a baffle member 52. The air box 51 can be hollow. The air box 51 defines an air inlet opening 515 and an air outlet opening 516. The air inlet tube 20 communicates with the air box 51 via the air inlet opening 515. The air box 51 communicates with the working space 11 via the air outlet opening 516. The baffle member 52 can be arranged on the air box 51. The baffle member 52 is configured to block completely, block partially, or not block the flow of the cooling air from the air inlet tube 20 into the air box 51, and accordingly block completely, block partially, or not block the flow of the cooling air from the air inlet tube 20 into the working space 11. The baffle member 52 is slidably coupled to the air box 51. The baffle member 52 can be slid to adjust an amount of the cooling air that is introduced into the air box 51, to adjust the temperature of the working space 11. Thus, the temperature of the environment where the working station 12 is located can be adjusted.

In some embodiments, the air inlet opening 515 and the air outlet opening 516 can be defined in the same wall of the air box 51, or the air inlet opening 515 and the air outlet opening 516 can be defined in different walls of the air box 51, the disclosure is not limited herein.

For example, the air inlet opening 515 and the air outlet opening 516 are defined in adjacent walls of the air box 51. It can be understood that when the air inlet opening 515 and the air outlet opening 516 are defined in the different walls of the air box 51, the baffle member 52 can be slidably coupled to a wall of the air box 51 defining the air inlet opening 515, and the baffle member 52 is slid to cover the air inlet opening 515; or the baffle member 52 can be slidably coupled to a wall of the air box 51 defining the air outlet opening 516, and the baffle member 52 is slid to cover the air outlet opening 516.

Figure 3:
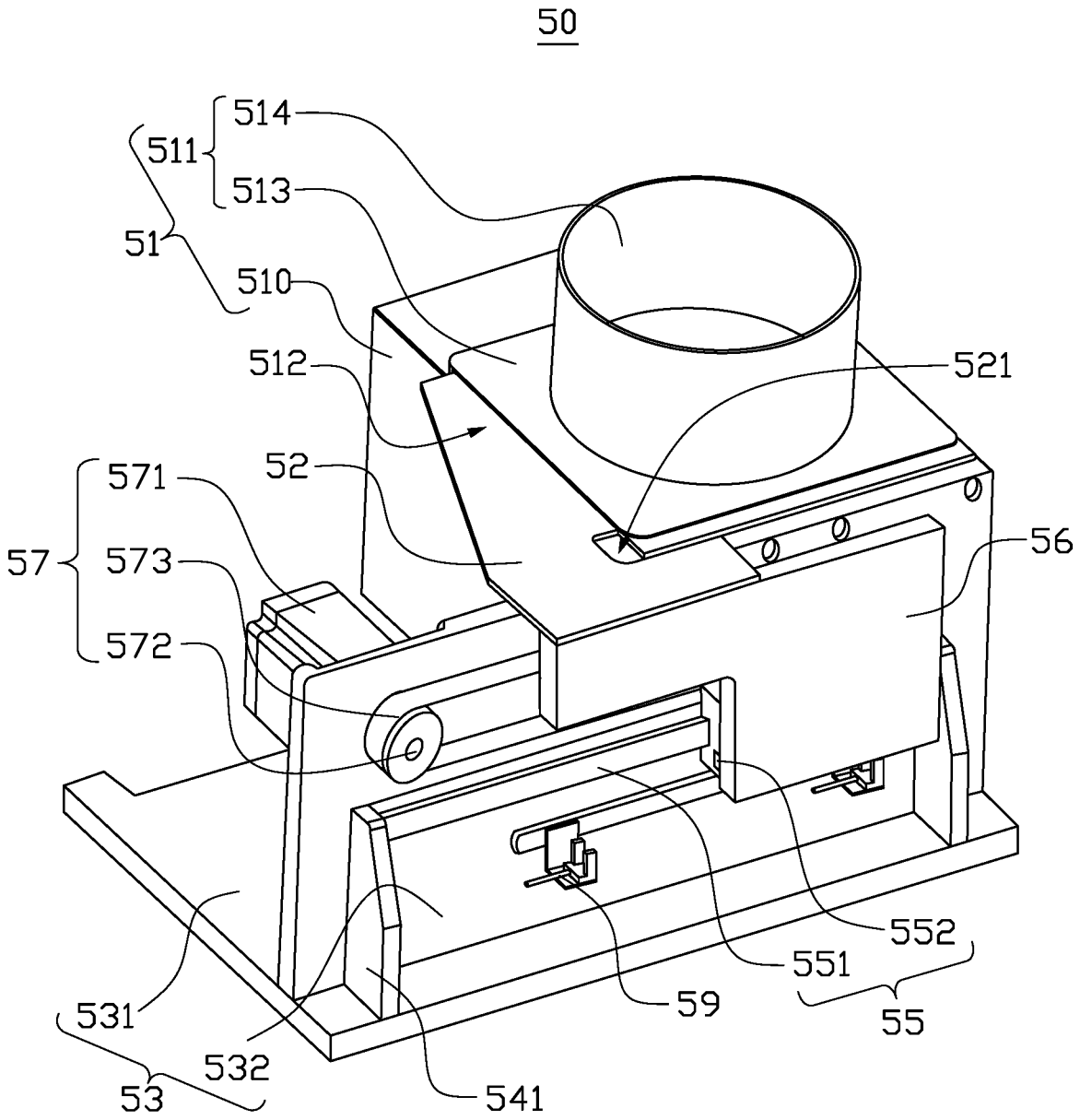
FIG. 3 is a schematic view of an embodiment of a device for automatic control of temperature.

Referring also to FIG. 3, in some embodiments, the air box 51 can include a casing 510 and a first connecting member 511. The casing 510 can be hollow. In FIG. 3, the air inlet opening 515 and the air outlet opening 516 are defined in opposite walls of the casing 510. The wall of the casing 510 defining the air inlet opening 515 defines a sliding groove 512 around the air inlet opening 515. The sliding groove 512 extends through an edge of the wall of the casing 510. The sliding groove 512 communicates with the air inlet opening 515. The baffle member 52 is substantially plate-shaped. The baffle member 52 can slide into the sliding groove 512 from the edge of the wall of the casing 510. The baffle member 52 is slidably coupled to the casing 510 via the sliding groove 512. The first connecting member 511 can be installed on the casing 510 at the air inlet opening 515 and the sliding groove 512. The first connecting member 511 is coupled to the air inlet tube 20. The cooling air in the air inlet tube 20 enters into the air box 51 via the first connecting member 511 when the air inlet opening 515 is not blocked by the baffle member 52.

The first connecting member 511 can include a cover plate 513 and an extending tube 514. The cover plate 513 is installed on the casing 510 at the sliding groove 512. The cover plate 513 can define a through hole. The through hole can extend through the cover plate 513. The extending tube 514 is fixed to the cover plate 513 at the through hole. The extending tube 514 can be hollow and have two openings at opposite ends of the extending tube 514. The openings of the extending tube 514 align with the through hole of the cover plate 513. The extending tube 514 communicates with the sliding groove 512 and the air inlet opening 515 via the through hole of the cover plate 513 when the air inlet opening 515 is not completely blocked by the baffle member 52.

It can be understood that, in some embodiments, the slidable coupling of the baffle member 52 to the air box 51 can take the form of the baffle member 52 being slidably arranged on the air box 51, for example, the baffle member 52 being slidably coupled to the cover plate 513 or slidably coupled to the machine 10, the disclosure is not limited herein.

In can be understood that the baffle member 52 can be slid in the sliding groove 512 to adjust a covering area of the air inlet opening 515, thus the amount of the cooling air that enters into the casing 510 and the working space 11 can be adjusted, and a temperature adjustment of the working space 11 can be achieved.

In can be understood that the manner of installing the cover plate 513 on the casing 510 can be by, but is not limited to, screwing, latching, or the like.

In some embodiments, a part of the baffle member 52 enters into the sliding groove 512 and is slidably coupled to the air box 51 at the sliding groove 512. The other part of the baffle member 52 extends outside the sliding groove 512. The other part of the baffle member 52 extending outside of the sliding groove 512 defines a retreating gap 521. When the baffle member 52 is sliding in the sliding groove 512, the sidewall of the casing 510 forming the sliding groove 512 can move in the retreating gap 521.

It can be understood that the wall of the casing 510 defining the air outlet opening 516 can define the sliding groove 512 around the air outlet opening 516. The baffle member 52 is slid in the sliding groove 512 to adjust an area of the air outlet opening 516 which is covered, thus the amount of the cooling air that enters into the working space 11 can be adjusted, and a temperature adjustment of the working space 11 can be achieved In some embodiments, the device 50 can further include a structural base 53. The structural base 53 is coupled to the machine 10. The casing 510 is fixed to the structural base 53. The structural base 53 can include a first plate 531 and a second plate 532 substantial perpendicular to the first plate 531. The second plate 532 is fixed to the first plate 531. The casing 510 is fixed to the first plate 531 and the second plate 532. The first plate 531 is fixed to the machine 10.

It can be understood that the manner of fixing between the first plate 531 and the second plate 532 can be by, but is not limited to, screwing, soldering, or the like.

It can be understood that the first plate 531 can be installed inside the machine 10, for example, the first plate 531 can be fixed to an inner wall of the machine 10 and forming the working space 11. The manner of fixing between the first plate 531 and the inner wall of the machine 10 can be by, but is not limited to, screwing, soldering, fixing via a supporting member, or the like.

In some embodiment, the device 50 can further include a guiding assembly 55. The guiding assembly 55 can include a sliding rail 551 and a sliding block 552. The sliding rail 551 is fixed to the second plate 532. The sliding rail 551 and the casing 510 are arranged on opposite surfaces of the second plate 532. The sliding block 552 is slidably coupled to the sliding rail 551. In some embodiments, the sliding block 552 is pivoted on the sliding rail 551. A length direction of the sliding rail 551, a length direction of the second plate 532, and a sliding direction of the baffle member 52 in the sliding groove 512 can be the same. The sliding block 552 is slidably coupled to the sliding rail 551 and slide along the length direction of the sliding rail 551.

In some embodiments, the baffle member 52 is coupled to the sliding block 552 via a second connecting member 56. A first end of the second connecting member 56 is fixed to the baffle member 52, and a second end of the second connecting member 56 is fixed to the sliding block 552. The manner of fixing between the second connecting member 56 and the baffle member 52, and the manner of fixing between the second connecting member 56 and the sliding block 552 can be by, but is not limited to, screwing or the like.

It can be understood that the baffle member 52 and the sliding block 552 can synchronously slide via a coupling of the baffle member 52 and the sliding block 552 via the second connecting member 56.

In some embodiments, two stopping members 541 are fixed to the first plate 531. The stopping members 541 are arranged at opposite ends of the sliding rail 551. In some embodiments, the stopping members 541 are fixed to the second plate 532. The stopping members 541 can block a sliding of the sliding block 552 at the ends of the sliding rail 551, avoiding disengagement of the sliding block 552 from the sliding rail 551. In some embodiments, the number of the stopping members 541 can be altered, for example being one only.

In some embodiment, in detail, one end of the second connecting member 56 resists against one stopping member 541, and the other end of the second connecting member 56 resists against another stopping member 541. The stopping members 541 can limit a movement distance of the second connecting member 56, and limit a movement distance of the sliding block 552. Thus, disengagement of the sliding block 552 from the sliding rail 551 is prevented.

In some embodiments, the device 50 can further include a driving assembly 57. The driving assembly 57 is configured to drive the baffle member 52 to move. The driving assembly 57 can include a motor 571, a number of synchronous gears 572, and a synchronous belt 573. The motor 571 is fixed to the second plate 532. The synchronous gears 572 are arranged at intervals along the length direction of the second plate 532. One synchronous gear 572 is coaxially fixed to an output shaft of the motor 571. One or more another synchronous gears 572 are rotatably coupled to the second plate 532. The synchronous belt 573 is wound around the synchronous gears 572. When the motor 571 works, the motor 571 rotates the synchronous gears 572 and the synchronous belt 573. The sliding block 552 is fixed to a transmission side of the synchronous belt 573. In some embodiments, the synchronous belt 573 can include two transmission sides. Two transmission sides cooperatively drive the one or more another synchronous gears 572 by the one synchronous gear 572. Thus, when the motor 571 rotates the synchronous belt 573, the sliding block 552 is brought by the synchronous belt 573 to move along the sliding rail 551.

A movement of the second connecting member 56 and the baffle member 52 can be achieved.

In some embodiments, the sliding block 552 is fixed to the transmission side of the synchronous belt 573 via a fixing member. The fixing member can include two clipping blocks. The two clipping blocks can clip onto the synchronous belt 573 from two sides of the synchronous belt 573. The two clipping blocks can be fixed to each other. The manner of fixing between the two clipping blocks can be by, but is not limited to, screwing or the like. The sliding block 552 can be fixed to one fixing member. The manner of fixing between the sliding block 552 and the fixing member can be by, but is not limited to, screwing or the like. When the synchronous belt 573 is brought to rotate, the clipping blocks can move along the length direction of the second plate 532 with the synchronous belt 573, to bring the sliding block 552, the second connecting member 56, and the baffle member 52 to move synchronously.

It can be understood that the second connecting member 56 can be fixed to a transmission side of the synchronous belt 573, but not the sliding block 552 being fixed to the transmission side of the synchronous belt 573, causing the synchronous belt 573 to bring the second connecting member 56 to move, the disclosure is not limited herein.

In can be understood that the manner of rotatable coupling between the one or more another synchronous gears 572 and the second plate 532 can be, but is not limited to, a rotatable connecting member, for example, a bearing, a shaft, or the like.

It can be understood that the manner of fixing between the one synchronous gear 572 and the output shaft of the motor 571 can be, but is not limited to, key joint or the like.

It can be understood that the motor 571 can be, but is not limited to, a stepper motor or the like. A time of operation of the motor 571 or a rotation angle of the output shaft of the motor 571 can be controlled to control a movement distance of the sliding block 552 and the baffle member 52.

For example, when the motor 571 is a stepper motor, the motor 571 works after receiving a pulse voltage signal. For example, when the number of pulses of the pulse voltage signal is one, the output shaft of the motor 571 rotates a preset angle, thus the motor 571 can be controlled to rotate a desired angle by controlling a pulse number of the pulse voltage signal input into the motor 571, and accordingly the sliding block 552 and the baffle member 52 can be controlled to move a precise desired distance.

Figure 4:
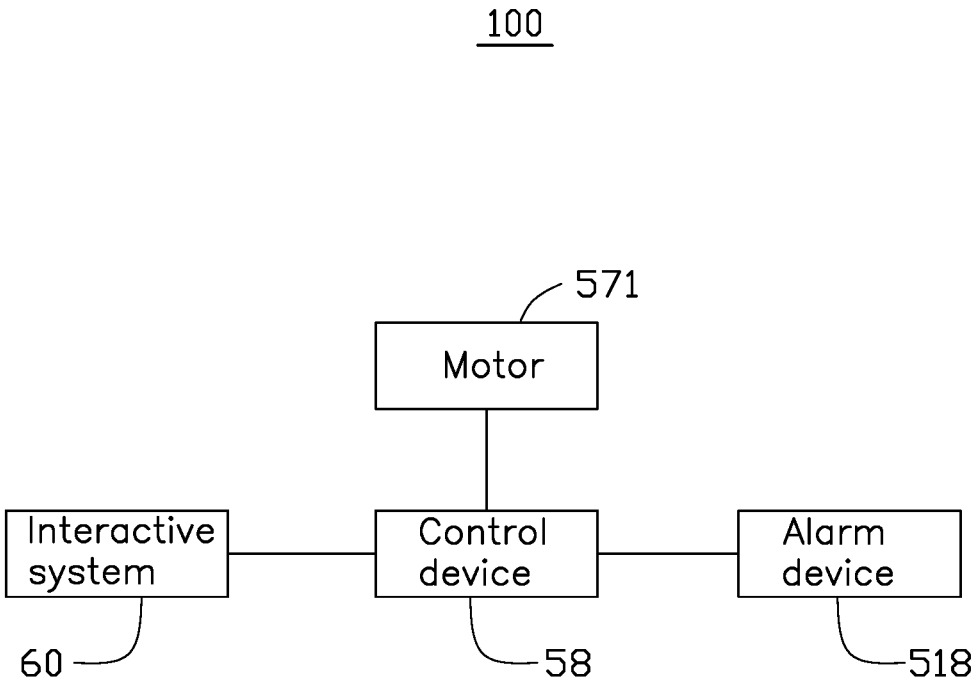
FIG. 4 is another schematic view of an embodiment of the system for automatic control of temperature.

Referring to FIG. 4, in some embodiments, the system 100 can further include a control device 58. The control device 58 is communicatively coupled to the motor 571 and the temperature detection unit 40 (see FIG. 1). The temperature detection unit 40 detects a temperature of the working space 11. The control device 58 obtains temperature detection information from the temperature detection unit 40. The temperature detection information corresponds to the temperature of the working space 11. The control device 58 obtains target temperature information, and outputs a movement triggering signal to the motor 571 according to the target temperature information and the temperature detection information, to control the output shaft of the motor 571 to rotate the desired angle. Thus, the baffle member 52 (see FIG. 3) can be controlled to move the desired distance. The target temperature information corresponds to a desired target temperature of environment where the working station 12 is located.

It can be understood that the target temperature information can be input by an operator, the value of the target temperature information can be a value of the desired target temperature or a desired target range of temperature value.

It can be understood that the target temperature information can be input by the operator via an interactive system 60. The control device 58 is communicatively coupled to the interactive system 60. The control device 58 obtains the target temperature information from the interactive system 60. In some embodiments, the operator can input a detail value of the temperature or a detail range of the temperature via the interactive system 60 according to a determined desired target temperature of the environment where the working station 12 is located, the control device 58 obtains the target temperature information which is the detail value of the temperature or the detail range of the temperature.

For example, the control device 58 can be a computer, and the interactive system 60 can be a keyboard coupled to the computer, the operator operates the keyboard to input the target temperature information which is one or more Arabic numerals to the computer.

Figure 5:
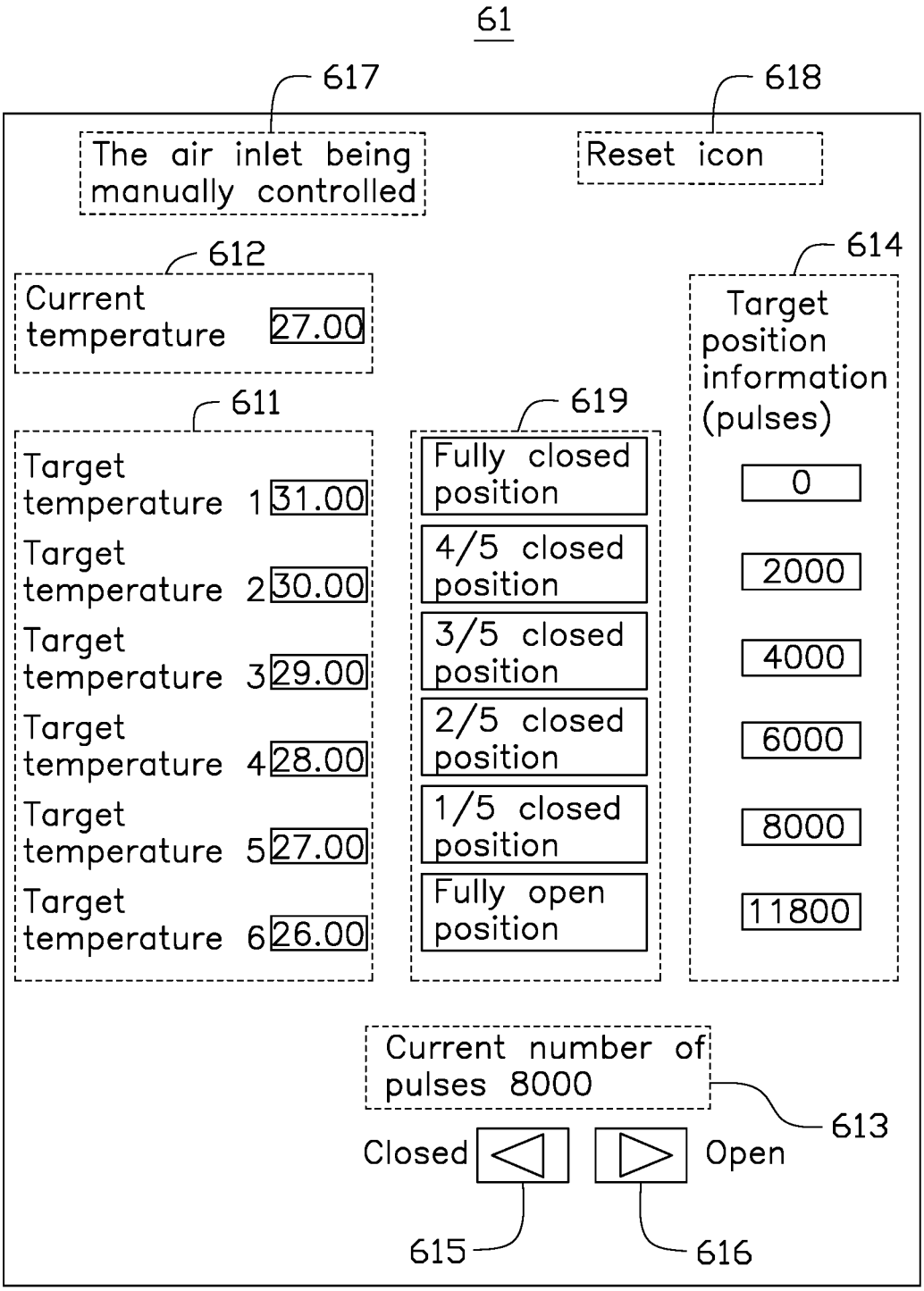
FIG. 5 is a schematic view of an embodiment of a display interface being displayed.

Referring also to FIG. 5, in some embodiments, a display interface 61 can be displayed on the interactive system 60. A number of target values of temperature 611 are displayed in the display interface 61. After an interactive operation between the operator and the interactive system 60, the control device 58 obtains the target temperature information via the interactive system 60. The temperature corresponding to the target temperature information can be one value of temperature or one range of temperature values corresponding to the target value of temperature 611. It can be understood that the target values of temperature 611 in the display interface 61 are only an illustration, and the disclosure is not limited to the illustrated herein. The display interface 61 can further include a number of target position relationship information 619. Each target position relationship information 619 can be a position where the baffle member 52 moves to cover an area of the air inlet opening 515 by the baffle member 52 when the environmental temperature of the working station 12 needs to reach one value of temperature corresponding to the target value of temperature 611. Thus, each target position relationship information 619 corresponds to one target value of temperature 611.

It can be understood that the display of the target value of temperature 611 and the target position relationship information 619 can directly show an environmental temperature of the working station 12 can reach when the baffle member 52 is slid to one target position.

The operator can directly see and select a required temperature.

For example, a number of target values of temperature 611 are displayed in the display interface 61, one target value of temperature 611 is 31° C. (degree Celsius) and the position where the baffle member 52 moves to cover an area of the air inlet opening 515 by the baffle member 52 is fully closed corresponding to the 31° C., thus the target position relationship information 619 in the display interface 61 is "fully closed position".

For example, a number of target values of temperature 611 are displayed in the display interface 61, one target value of temperature 611 is 29° C., and the position where the baffle member 52 moves to cover an area of the air inlet opening 515 by the baffle member 52 is ⅗ of area of the air inlet opening 515 corresponding to the 29° C., thus the target position relationship information 619 in the display interface 61 is "⅗ closed position".

It can be understood that the control device 58 and the interactive system 60 can be respectively two components of the computer, for example, the interactive system 60 can be a display of the computer, thus the display interface 61 can be displayed via the display of the computer.

In some embodiments, the display interface 61 can include a current temperature column 612. After the control device 58 obtains the temperature detection information, the control device 58 outputs a current temperature corresponding to the temperature detection information to the interactive system 60, causing the current temperature to be displayed in the current temperature column 612 of the display interface 61.

It can be understood that the interactive system 60 can be an electric device with an interactive function capable of displaying the display interface 61. The interactive system 60 can be, but is not limited to, a tablet PC, or a computer with a display, a keyboard, or a mouse, or the like.

Referring back to FIG. 3, in some embodiments, the device 50 can further include a position detection unit 59. The position detection unit 59 is fixed to the second plate 532. The position detection unit 59 is configured to detect a position of the sliding block 552. The control device 58 obtains position detection information from the position detection unit 59. The position detection information corresponds to the position of the sliding block 552. The sliding block 552 is coupled to the baffle member 52 via the second connecting member 56. Thus, the position detection information represents a position of the baffle member 52, that is, the position detection unit 59 can be configured to detect a position of the baffle member 52.

It can be understood that the position detection unit 59 can be a sensor having a position detection function. The position detection unit 59 can be, but is not limited to, an infrared sensor or the like.

In some embodiments, the position detection unit 59 can be an infrared sensor. A propagation direction of infrared ray emitted from the position detection unit 59 can be the same as the length direction of the sliding rail 551. The position detection unit 59 can detect a distance between the sliding block 552 and the position detection unit 59 to determine the position of the sliding block 552.

Referring also to FIGS. 4-5, in some embodiments, the display interface 61 can further include a current position column 613. Current position information of the sliding block 552 is displayed in the current position column 613 according to the position detection information. After the control device 58 obtains the position detection information from the position detection unit 59, the control device 58 outputs a current position of the sliding block 552 corresponding to the position detection information to the interactive system 60, causing the current position information of the sliding block 552 to be displayed in the current position column 613 of the display interface 61 of the interactive system 60.

It can be understood that the motor 571 can be a stepper motor. The current position of the sliding block 552 on the sliding rail 551 indicates a current position of the baffle member 52. One end of the sliding rail 551 can be a starting position of the sliding block 552, for example, in FIG. 3, a right end of the sliding rail 551 can be a starting position of the sliding block 552. When the sliding block 552 is at the starting position on the sliding rail 551, the baffle member 52 covers the air inlet opening 515 (see FIG. 2A) completely, that is, the air inlet opening 515 is fully closed. When the motor 571 receives a pulse voltage signal with a preset number of pulses, the sliding block 552 is driven by the motor 571 to move a preset distance on the sliding rail 551, the baffle member 52 is brought by the sliding block 552 via the second connecting member 56 to move synchronously, to adjust an area of the air inlet opening 515 covered by the baffle member 52, thus the temperature of the environment where the working station 12 is located can reach one target value of temperature 611. In some embodiments, the position detection unit 59 can be installed at the starting position. The distance between the sliding block 552 and the position detection unit 59 detected by the position detection unit 59 can be equal to a distance that the sliding block 552 is away from the starting position. The position detection information from the position detection unit 59 can be corresponding to the distance that the sliding block 552 is away from the starting position. After the control device 58 obtains the position detection information from the position detection unit 59, the control device 58 converts a distance that the sliding block 552 is away from the starting position into the number of pulses of the pulse voltage signal received by the motor 571, and outputs the current position information of the sliding block 552 to the interactive system 60 according to the number of the pulses of the pulse voltage signal, causing the number of the pulses to be displayed in the current position column 613 of the display interface 61. Thus, the current position column 613 indicates the current position information of the sliding block 552 (hereinafter current position information).

For example, when the baffle member 52 covers ⅕ of area of the air inlet opening 515, the current temperature of the working space 11 is determined to be 27° C. according to the temperature detection information, namely, the current environmental temperature of the working station 12 is 27° C. The distance that the sliding block 552 is away from the starting position can be a distance N according to the current position of the sliding block 552 from the position detection unit 59. The control device 58 determines that the number of the pulses of the pulse voltage signal received by the motor 571 corresponding to the distance N is 8000. Thus, a content of "current pulse number 8000" is displayed in the current position column 613 of the display interface 61 when a content of "current temperature 27.00" is displayed in the current temperature column 612 of the display interface 61.

In some embodiments, a number of target position information of the sliding block 552 (hereinafter target position information 614) corresponding to the target value of temperature 611 are displayed in the display interface 61. A content of each target position information 614 can be a preset number of the pulses of the pulse voltage signal received by the motor 571 when the temperature of the working station 12 needs to reach a corresponding value of temperature and the sliding block 552 needs to move to a corresponding position from the starting position.

For example, if the baffle member 52 covers the air inlet opening 515 completely, namely, the air inlet opening 515 is fully closed, the sliding block 552 is at the starting position on the sliding rail 551, thus the displayed content of the target position information 614 is zero; if the baffle member 52 does not cover the air inlet opening 515 at all, namely, the air inlet opening 515 is fully open, the distance that the sliding block 552 is away from the starting position on the sliding rail 551 is a distance M, and the pulse number of the pulse voltage signal received by the motor 571 corresponding to the distance M is 11800, thus the displayed content of the target position information 614 is 11800.

For example, a number of target values of temperature 611 are displayed in the display interface 61, one target value of temperature 611 is 29° C., the displayed content of the target position information 614 on the display interface 61 corresponding to 29° C. is 4000. Where 4000 is the pulse number of the pulse voltage signal received by the motor 571 that needs to be reached, when the environmental temperature of the working station 12 needs to reach is 29° C., and the sliding block 552 needs to move to the target position relationship information corresponding to 29° C. from the starting position.

It can be understood that the control device 58 determines the target temperature information in response to an operation on the display interface 61 via the interactive system 60, for example, in response to a selection operation on one target value of temperature 611 of the display interface 61 via the interactive system 60. The control device 58 also obtains the target position information 614 corresponding to the target value of temperature 611. In some embodiments, the content of the target position information 614 can be a pulse number, and each target value of temperature 611 corresponds to one unique pulse number of the pulse voltage signal, thus each target temperature information corresponds to one unique pulse number. Similarity, each current temperature of the working space 11 corresponding to the temperature detection information corresponds to a current position of the sliding block 552 corresponding to the position detection information, and the content of the current position column 613 can be a pulse number, thus each temperature detection information corresponds to one unique pulse number. Thus, the control device 58 calculates a difference value of pulses between the number of the pulses corresponding to the target temperature information and the number of the pulses corresponding to the temperature detection information. In some embodiments, the difference value of the pulses can be the number of the pulses of the pulse voltage signal needing to output to the motor 571. In some embodiments, the control device 58 outputs a movement triggering signal whose number of the pulses is the difference value of pulses to the motor 571.

For example, the temperature of the environment where the working station 12 is located corresponding to the target temperature information is 29° C., and the current temperature of the working space 11 corresponding to the temperature detection information is 27° C., the content of the target position information 614 corresponding to the target temperature information is a pulse number of 4000, and the content of the current position column 613 in the display interface 61 is a pulse number of 8000, thus the control device 58 determines that that the difference value of pulses is 4000. The control device 58 outputs a movement triggering signal which is a pulse voltage signal with a number of the pulses of 4000 to the motor 571, to drive the sliding block 552 to move. The baffle member 52 is accordingly brought to cover a certain area of the air inlet opening 515 by the sliding block 552. Thus, the temperature of the environment where the working station 12 is located can be adjusted.

In some embodiments, the target values of temperature 611, the target position relationship information 619, and the target position information 614 are default configurations of the system 100. Thus, many preset values of temperature, much target position relationship information 619, and much target position information 614 can be displayed in the display interface 61. Each target value of temperature 611 corresponds to one target position relationship information 619 and one target position information 614.

In some embodiments, the control device 58 can add, edit, or delete one or more target values of temperature 611, one or more target position relationship information 619, and one or more target position information 614 in the display interface 61 in response to user operation on the display interface 61 via the interactive system 60. In some embodiments, one or more preset values of temperature 611, one or more target position relationship information 619, and one or more target position information 614 supporting customized settings can be displayed in the display interface 61, for example, preset temperature P:

It can be understood that the position detection unit 59 can detect a current position of the baffle member 52, the reference numeral 613 can be current position information of the baffle member 52, and the reference numeral 614 can be target position information of the baffle member 52, the disclosure is not limited herein.

In some embodiments, a data latching icon 615 and a data adjusting icon 616 can be displayed in the display interface 61. The operator can operate the interactive system 60 to select the data latching icon 615 or the data adjusting icon 616. When the data adjusting icon 616 is selected, the target values of temperature 611 and the target position information 614 can be adjusted, the operator can edit the target value of temperature 611 and the target position information 614. After the operator performs editing in the display interface 61, the operator can operate the interactive system 60 to select the data latching icon 615, then at that moment, the target value of the temperature 611 and the target position information 614 are not adjustable.

In some embodiments, the display interface 61 can include a data state column 617. When the data latching icon 615 is selected, the target value of temperature 611 and the target position information 614 cannot be adjusted, data is latched, a data state is a latched state, thus a content of the data state column 617 can be information corresponding to the latched state; when the data adjusting icon 616 is selected, the target value of temperature 611 and the target position information 614 can be adjusted, the data can be adjusted, the data state is an adjustable state, thus a content of the data state column 617 can be information corresponding to the adjustable state.

For example, the data state column 617 can be a text box whose shape is a rectangle and with some characters within. When the data state is the latched state, the content of the data state column 617 can be "the air inlet being automatically controlled". When the data state is the adjustable state, the content of the data state column 617 can be "the air inlet being manually controlled".

It can be understood that the input of one or more target values of temperature 611 and target position information 614 can be detected previously via the temperature detection unit 40 and the position detection unit 59.

It can be understood that one icon selected from the data latching icon 615 and the data adjusting icon 616 can be displayed in the display interface 61, when the icon is selected in an odd number frequency, the data state enters into the latched state, when the icon is selected in an even number frequency, the data state enters into the adjustable state, the disclosure is not limited herein.

In some embodiment, a reset icon 618 is displayed in the display interface 61. The operator can operate the interactive system 60 to select the reset icon 618. The control device 58 outputs reset information to the motor 571 in response to user operation on the reset icon 618, triggering the motor 571 to drive the sliding block 552 to move back to the starting position on the sliding rail 551.

It can be understood that when the motor 571 drives the sliding block 552 to move to the starting position on the sliding rail 551 according to the reset information, the position detection unit 59 detects the current position of the sliding block 552 in real time or at intervals. The control device 58 obtains the position detection information from the position detection unit 59 in real time or at intervals. The position detection information corresponds to the current position of the sliding block 552. The control device 58 analyzes the position detection information to determine whether the sliding block 552 moves to the starting position on the sliding rail 551. If the control device 58 determines that the sliding block 552 has moved to the starting position on the sliding rail 551, the control device 58 controls the motor 571 to stop working. If the control device 58 determines that the sliding block 552 has not moved to the starting position on the sliding rail 551, the control device 58 continuously controls the motor 571 to work and continuously obtains and analyzes the position detection information until the sliding block 552 reaches the starting position on the sliding rail 551. Thus, the reset of the sliding block 552 is completed.

In some embodiments, the system 100 can further include an alarm device 518. The alarm device 518 is communicatively coupled to the control device 58. The control device 58 outputs an alarm signal to the alarm device 518, to control the alarm device 518 to prompt the operator to manually operate a test or a production process on the working station 12.

In can be understood that a triggering condition that the control device 58 outputs the alarm signal can be that the device 50 cannot continue to test or process the product or the semi-finished product. At that moment, the operator needs to manually operate the test or the process on the working station 12.

For example, after the control device 58 obtains the target temperature information, if the control device 58 determines that the temperature of the environment where the working station 12 is located corresponding to the target temperature information is out of a temperature adjustment range of the device 50, the control device 58 outputs the alarm signal.

It can be understood that the alarm device 518 can be, but is not limited to, a buzzer, a warning light, or the like.

For example, if the alarm device 518 is a buzzer, the control device 58 outputs the alarm signal to the alarm device 518 to control the alarm device 518 to give an alarm.

In some embodiments, the alarm device 518 can be installed on the machine 10; in some embodiments, the alarm device 518 can be installed at a wall or floor of the environment where the system for automatic control of temperature 100 is located, the disclosure is not limited herein.

It can be understood that the device 50 can control the temperature of the working space 11 without the control device 58, the disclosure is not limited herein.

It can be understood that the air box 51 can define at least one opening 517 (see FIG. 1) for the cooling air to be introduced into the working space 11, for example, an air inlet opening or an air outlet opening, or the aforementioned air inlet opening 515 and the aforementioned air outlet opening 516, the disclosure is not limited herein.

The principle of the system 100 can be further illustrated by FIG. 1 to FIG. 5 in conjunction with the embodiments below:

In some embodiments, before processing the product or the semi-finished product, the operator can control the motor 571 to work via the control device 58, causing the baffle member 52 to move to the target position relationship information 619 one by one. The operator records the environmental temperature of the working station 12 via the temperature detection unit 40 one by one when the baffle member 52 moves to the target position relationship information 619 one by one. The operator can further record the number of pulses of the pulse voltage signal received by the motor 571 one by one when the baffle member 52 moves to the target position relationship information 619 one by one. The operator can further input the recorded environmental temperatures of the working station 12 and the recorded numbers of the pulses into the control device 58 via the interactive system 60, the control device 58 outputs the environmental temperatures of the working station 12 and the numbers of pulses employed to the interactive system 60, causing the interactive system 60 to display in the display interface 61.

After setting the relationship between the target values of temperature 611, the target position relationship information 619, and the target position information 614, the system 100 can automatically adjust the environmental temperature of the working station 12.

In some embodiments, the operator can determine the target environmental temperature of the working station 12 which needs to be reached according to a requirement of the environment of test or production. The operator can input the target temperature information to the control device 58 via the interactive system 60. The control device 58 analyzes the target temperature information, to determine whether the target environmental temperature of the working station 12 which needs to be reached is out of the temperature adjustment range of the device 50. If such target environmental temperature of the working station 12 is out of the temperature adjustment range of the device 50, the control device 58 controls the alarm device 518 to give the alarm.

If such target environmental temperature of the working station 12 is within the temperature adjustment range of the device 50, the control device 58 analyzes the target temperature information and the temperature detection information to determine the pulse number of the pulse voltage signal needing to output to the motor 571, and outputs the movement triggering signal to the motor 571 according to the pulse number. Thus, the motor 571 drives the sliding block 552 and the baffle member 52 to move, causing the baffle member 52 to move to the preset position, thus a covered area of the air inlet opening 515 can be adjusted, and the temperature of the working space 11 can be adjusted accordingly. Thus, the temperature of the environment where the working station 12 is located can be adjusted accordingly. In some embodiments, when the air inlet opening 515 is covered completely by the baffle member 52, the temperature of the working space 11 is the highest. When the air inlet opening 515 is completely not covered by the baffle member 52, the temperature of the working space 11 is the lowest.

Figure 6:
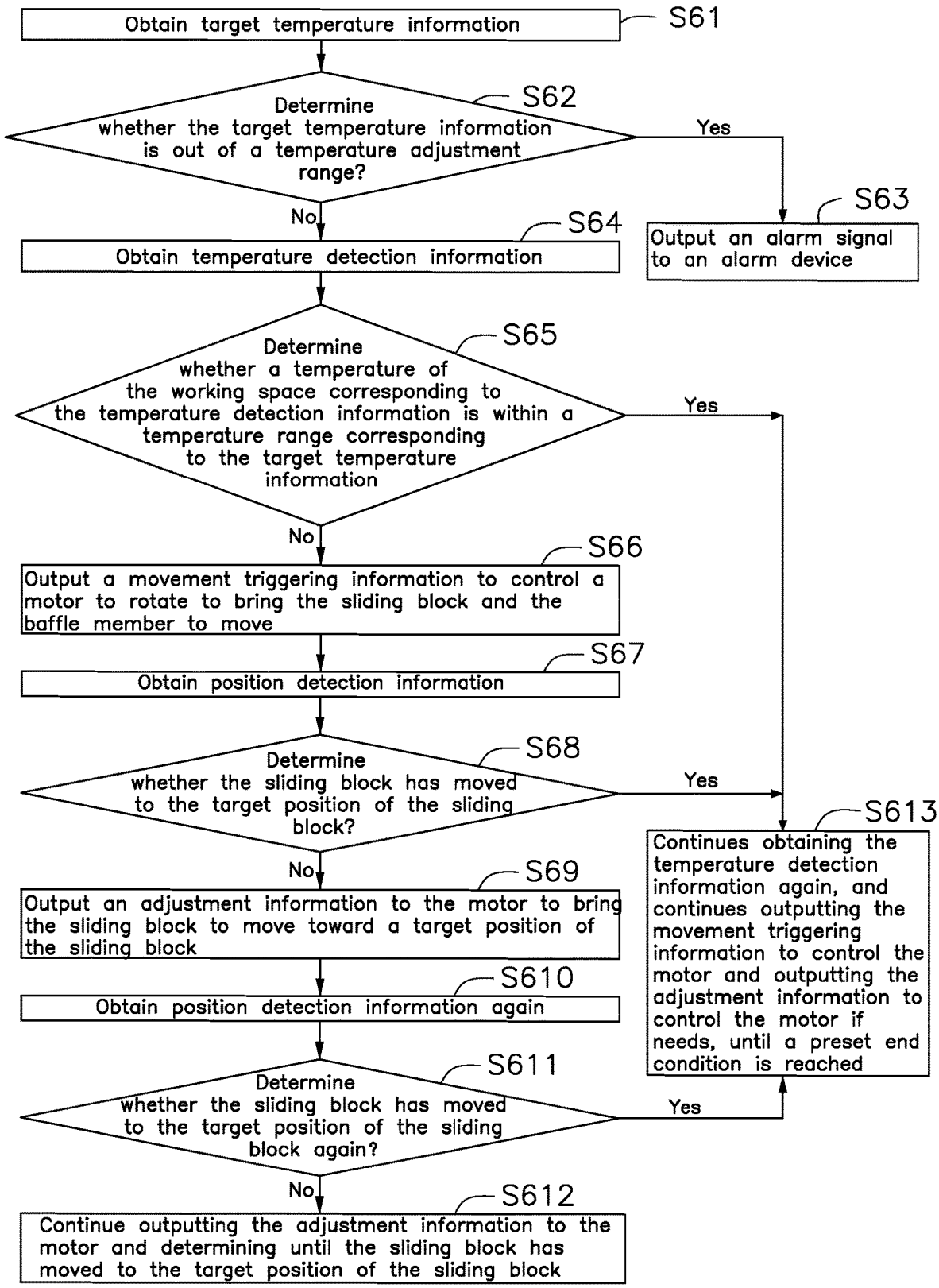
FIG. 6 is a flowchart of an embodiment of a method for automatic control of temperature.

Referring to FIG. 6, FIG. 6 is a flowchart of an embodiment of a method for automatic control of temperature. The method can be applied on the system 100. The method can include:

At step S61, the control device obtains target temperature information.

It can be understood that, the operator can input the target temperature information to the control device via the interactive system.

At step S62, the control device determines whether the target temperature information is out of a temperature adjustment range of the device for automatic control of temperature.

It can be understood that, the temperature adjustment range of the device for automatic control of temperature can be a temperature range capable of adjusting by the device for automatic control of temperature. In detail, a setting of the temperature adjustment range can refer to a temperature of the cooling air output from the air-conditioning system connecting to the device for automatic control of temperature, and a temperature of the environment where the system is located. The temperature adjustment range can be detected via the temperature detection unit previously by maintaining the temperature of the cooling air output from the air-conditioning system and maintaining the environmental temperature of the system.

For example, at a condition that the temperature of the cooling air output from the air-conditioning system is maintained and the environmental temperature of the system is maintained, when the baffle member convers the air inlet opening completely, the temperature of the working space detected by the temperature detection unit is 31° C. When the baffle member does not cover the air inlet opening, the temperature of the working space detected by the temperature detection unit is 26° C., thus the temperature adjustment range can be set to be a range of 26° C. to 31° C. previously.

For example, during testing or production of the product or the semi-finished product, when the temperature adjustment range is a range of 26° C. to 31° C., and the temperature of the working space detected by the temperature detection unit is 26° C., thus the control device determines that the target temperature information is out of the temperature adjustment range of the device for automatic control of the temperature.

At step S63, the control device outputs an alarm signal to an alarm device if the target temperature information is out of the temperature adjustment range of the device for automatic control of the temperature.

It can be understood that, if the target temperature information is out of the temperature adjustment range of the device for automatic control of the temperature, the test or the production of the product or the semi-finished product can not be completed in the system. At the moment, the alarm signal can be output to prompt the operator, for example prompt the operator to move the product and the semi-finished product to another system, or prompt the operator to adjust the temperature of the cooling air output from the air-conditioning system. Thus, the product and the semi-finished product can be continuously processed.

At step S64, the control device obtains temperature detection information from the temperature detection unit if the target temperature information is within the temperature adjustment range of the device for automatic control of the temperature.

A detail of obtaining temperature detection information from the temperature detection unit can be referred to the related description of the embodiment of the system, which will not be described herein.

At step S65, the control device determines whether the temperature of the working space corresponding to the temperature detection information is within a temperature range corresponding to the target temperature information.

It can be understood that, the target temperature information can correspond to a preset temperature range. The preset temperature range can be a temperature range whose center is the target temperature information.

For example, the target value of temperature selected by the operator is 29° C. in the display interface, thus the temperature corresponding to the target temperature information is 29° C. The target temperature information of 29° C. corresponding to a temperature range, for example, a temperature range of 28.5° C. to 29.5° C.

It can be understood that, in some embodiments, due to some reasons, for example, due to a flowing of the air, the temperature satisfying a requirement for testing or production of the product or the semi-finished product can be any value in the preset temperature range. Thus, when the environmental temperature of the working space corresponding to the temperature detection information is within the temperature range corresponding to the target temperature information, the temperature of the working space can satisfy the requirement for testing or production of the product or the semi-finished product, thus the temperature of the working station does not need to adjust.

At step S66, the control device outputs a movement triggering information to control a motor to rotate to bring the sliding block and the baffle member to move according to the temperature detection information and the target temperature information if the temperature of the working space corresponding to the temperature detection information is out of the temperature range corresponding to the target temperature information.

In some embodiments, a detail of outputting a movement triggering information to control a motor to rotate to bring the sliding block and the baffle member to move according to the temperature detection information and the target temperature information can be referred to the related description of the embodiment of the system, which will not be described herein.

At step S67, the control device obtains the position detection information from the position detection unit.

In some embodiments, a detail of obtaining the position detection information from the position detection unit can be referred to the related description of the embodiment of the system, which will not be described herein.

At step S68, the control device determines whether the sliding block has moved to the target position of the sliding block according to the position detection information and the target position information corresponding to the target temperature information.

It can be understood that, after a long time use, the motor, the synchronous belt, and the synchronous gears may have different wear conditions. When the motor rotates according to the received pulse voltage signal, a large difference may be existed between an actual movement distance of the synchronous belt and a preset movement distance. Whether there is the difference between the actual movement distance of the synchronous belt and the preset movement distance can be determined by comparing the position detection information with the preset position of the latching member.

It can be understood that, the sliding block and the baffle member are fixed via the second connecting member, thus when the sliding block has moved to the preset position of the sliding block, the baffle member also has moved to a desired position.

It can be understood that, whether the sliding block has moved to the preset position of the sliding block can be determined, by determining whether a different value of the pulse between the pulse number of the pulse voltage signal corresponding to the position detection information and the pulse number of the pulse voltage signal corresponding to the target position information is within a preset range. In some embodiments, the principle that each position detection information corresponds to one pulse number of the pulse voltage signal, and each target position information corresponds to one number of pulses of the pulse voltage signal can be referred to the related description of the embodiment of the system, which will not be described herein.

For example, the number of the pulses of the pulse voltage signal corresponding to the target position information can be 9000, the preset range can be a number of the pulses from −500 to 500, thus when the number of the pulses of the pulse voltage signal corresponding to the position detection information is within a range of 8500 to 9500, the sliding block has moved to the target position of the sliding block. It can be understood that, when the number of the pulses of the pulse voltage signal corresponding to the position detection information is within a range of 8500 to 9500, the baffle member also has moved to the desired position. When the number of the pulses of the pulse voltage signal corresponding to the position detection information is out of a range of 8500 to 9500, the sliding block has not already moved to the target position of the sliding block. It can be understood that, when the number of the pulses of the pulse voltage signal corresponding to the position detection information is out of a range of 8500 to 9500, the baffle member also has not moved to the desired position.

At step S69, the control device outputs an adjustment information to the motor to bring the sliding block to move toward a target position of the sliding block corresponding to the target temperature information continuously according to the position detection information and the target position information if the sliding block has not moved to the target position of the sliding block.

At step S610, the control device obtains the position detection information from the position detection unit again.

In some embodiments, during the motor moves the sliding block according to the adjustment information, the control device obtains the position detection information from the position detection unit again.

In some embodiments, after the motor moves the sliding block according to the adjustment information, the control device obtains the position detection information from the position detection unit again.

In some embodiments, a detail of obtaining the position detection information from the position detection unit again can be referred to the related description of the embodiment of the system, which will not be described herein.

At step S611, the control device determines whether the sliding block has moved to the target position of the sliding block again according to the position detection information obtained again and the target position information corresponding to the target temperature information.

A detail of determining whether the sliding block has moved to the preset position of the sliding block again can be referred description of the step S68, which will not be described herein.

At step S612, the control device continues outputting the adjustment information to the motor and determining whether the sliding block has moved to the target position of the sliding block until the sliding block has moved to the target position of the sliding block, if the sliding block has not moved to the target position of the sliding block.

For example, the target position of the sliding block is a position A, and the sliding block has moved to a position B, thus the control device determines that the sliding block has not moved to the target position of the sliding block. The control device continuously outputs the adjustment information to the motor to bring the sliding block to move toward the position A. The control device determines that the sliding block has moved to a position C, and determines that the sliding block has not moved to the target position of the sliding block. The control device outputs the adjustment information to the motor to bring the sliding block to move toward the position A again, and determines that the sliding block has moved to the position A. Thus, the control device determines that the sliding block has moved to the target position of the sliding block.

In can be understood that, the obtaining of the position detection information, the determining of whether the sliding block has moved to the target position of the sliding block, and the outputting of the adjustment information to the motor can be cycled if the sliding block has not moved to the target position of the sliding block. In some embodiments, the control device stops the outputting of the adjustment information to stop the rotating of the motor if the sliding block has moved to the target position of the sliding block.

At step S613, the control device continues obtaining the temperature detection information from the temperature detection unit again, and continues outputting the movement triggering information to control the motor and outputting the adjustment information to control the motor if needs, until a preset end condition is reached.

In some embodiments, the condition that the method performs the step S613 can be, for example, the temperature of the working space corresponding to the temperature detection information is within the temperature range corresponding to the target temperature information, or the sliding block has moved to the target position of the sliding block, or at preset intervals, or after a preset period of time after determining that the sliding block has moved to the target position of the sliding block, or after a preset period of time after determining that the temperature of the working space corresponding to the temperature detection information is within the temperature range corresponding to the target temperature information, or the like.

It can be understood that, during the test or production of the product or the semi-finished product, the control device can obtain the temperature detection information cyclically until the preset end condition is reached. And the controlling of the motor to bring the sliding block to move can be automatically according to a temperature change of the working station until the preset end condition is reached. The preset end condition can be, for example, the product or the semi-finished product has tested or produced completely, or an end signal is received via the interactive system by the operator, or the target temperature information has adjusted, or the like.

It can be understood that, after the test or production of the product or the semi-finished product, the control device can obtain a new target temperature information again, thus the control device can newly adjust the current temperature of the working space to the new target temperature information.

In this way, the method can automatically adjust the temperature of the working station.

It should be emphasized that the above-described embodiments of the present disclosure, including any particular embodiments, are merely possible examples of implementations, set forth for a clear understanding of the principles of the disclosure. Many variations and modifications can be made to the above-described embodiment(s) of the disclosure without departing substantially from the spirit and principles of the disclosure. All such modifications and variations are intended to be included herein within the scope of this disclosure and protected by the following claims.

What is claimed is:

1. A device for controlling an environmental temperature of a working station, the device comprising:

an air box coupled to a machine defining a working space where the working station is located, the air box defining at least one opening, the at least one opening being configured to provide an opening for cooling air to be introduced into the working space;

a baffle member slidably coupled to the air box at the opening;

a driving assembly coupled to the baffle member, the driving assembly being configured to drive the baffle member to cover the opening completely, to cover the opening partially, or to not cover the opening via a difference between a current temperature of the working space and a desired target temperature of the working space;

wherein the air box comprises a casing and a first connecting member, the opening is defined in the casing, the first connecting member is coupled to the casing at the opening, a sliding groove is defined in the casing or the first connecting member, the sliding groove communicates with the opening, the baffle member is slidably coupled to the air box at the sliding groove;

the baffle member extending outside of the sliding groove defines a retreating gap, the retreating gap is configured to receive a sidewall of the casing forming the sliding groove or a sidewall of the first connecting member forming the sliding groove.

2. The device according to claim 1, wherein the driving assembly comprises a motor, a plurality of synchronous gears, and a synchronous belt, the motor is fixed to one of the plurality of synchronous gears, the synchronous belt is wound around the plurality of synchronous gears, the baffle member is coupled to one side of the synchronous belt, the motor is operatively to drive the synchronous belt to bring the baffle member to cover the opening completely, to cover the opening partially, or to not cover the opening.

3. The device according to claim 2, further comprising a guiding assembly, wherein the guiding assembly comprises a sliding rail and a sliding block, the sliding block is slidably coupled to the sliding rail, the sliding block is coupled to the baffle member, and the baffle member is coupled to the one side of the synchronous belt via the sliding block.

4. The device according to claim 3, further comprising a structural base, wherein the structural base comprises a first plate and a second plate, the first plate is fixed to the machine, the second plate is fixed to the first plate, the motor and the sliding rail are fixed to opposite surfaces of the second plate, the plurality of synchronous gears and the synchronous belt are arranged at a same side of the second plate, one of the plurality of synchronous gears is fixed to an output shaft of the motor, the rest of the plurality of synchronous gears is rotatably coupled to the second plate.

5. The device according to claim 1, wherein the at least one opening comprises an air inlet opening and an air outlet opening, the baffle member is slidably coupled to the air box at the air inlet opening or the air outlet opening.

6. The device according to claim 1 further comprising a position detection unit, wherein the position detection unit is configured to detect a current position of the baffle member, the driving assembly is operatively to drive the baffle member to cover the opening completely, to cover the opening partially, or to not cover the opening via a difference between the current position of the baffle member and one of a plurality of target positions of the baffle member corresponding to the desired target temperature of the working space, each of the plurality of target positions of the baffle member corresponds to one of a plurality of the desired target temperatures of the working space.

7. A system for automatically controlling an environmental temperature of a working station, the system comprising:

an air box coupled to a machine defining a working space where the working station is located, the air box defining at least one opening, the at least one opening being configured to provide an opening for cooling air to be introduced into the working space;

a baffle member slidably coupled to the air box at the opening;

a driving assembly coupled to the baffle member;

a temperature detection unit configured to detect a current temperature of the working space;

a control device coupled to the driving assembly and the temperature detection unit, the control device being configured to control the driving assembly to drive the baffle member to cover the opening completely, to cover the opening partially, or to not cover the opening via a difference between the current temperature of the working space detected by the temperature detection unit and a desired target temperature of the working space;

wherein the air box comprises a casing and a first connecting member, the opening is defined in the casing, the first connecting member is coupled to the casing at the opening, a sliding groove is defined in the casing or the first connecting member, the sliding groove communicates with the opening, the baffle member is slidably coupled to the air box at the sliding groove;

the baffle member extending outside of the sliding groove defines a retreating gap, the retreating gap is configured to receive a sidewall of the casing forming the sliding groove or a sidewall of the first connecting member forming the sliding groove.

8. The system according to claim 7, wherein the driving assembly comprises a motor, a plurality of synchronous gears, and a synchronous belt, the motor is fixed to one of the plurality of synchronous gears, the synchronous belt is wound around the plurality of synchronous gears, the baffle member is coupled to one side of the synchronous belt, the control device is configured to output a movement triggering signal to the motor to drive the synchronous belt to bring the baffle member to cover the opening completely, to cover the opening partially, or to not cover the opening.

9. The system according to claim 8, further comprising a guiding assembly, wherein the guiding assembly comprises a sliding rail and a sliding block, the sliding block is slidably coupled to the sliding rail, the sliding block is coupled to the baffle member, and the baffle member is coupled to the one side of the synchronous belt via the sliding block.

10. The system according to claim 9, further comprising a structural base, wherein the structural base comprises a first plate and a second plate, the first plate is fixed to the machine, the second plate is fixed to the first plate, the motor and the sliding rail are fixed to opposite surfaces of the second plate, the plurality of synchronous gears and the synchronous belt are arranged at a same side of the second plate, one of the plurality of synchronous gears is fixed to an output shaft of the motor, the rest of the plurality of synchronous gears is rotatably coupled to the second plate.

11. The system according to claim 7, wherein the system further comprises a position detection unit, the position detection unit is configured to detect a current position of the baffle member, the motor is configured to control the driving assembly to drive the baffle member to cover the opening completely, to cover the opening partially, or to not cover the opening via a difference between the current position of the baffle member and one of a plurality of target positions of the baffle member corresponding to the desired target temperature of the working space, each of the plurality of target positions of the baffle member corresponds to one of a plurality of the desired target temperatures of the working space.

12. The system according to claim 7, further comprising an interactive system, wherein the interactive system is configured to provide an interface between an operator and the system, and the interactive system is configured to display a current temperature column and a current position column, wherein the current temperature of the working space is displayed in the current temperature column, and the current position of the baffle member is displayed in the current position column.

13. A method for automatically controlling an environmental temperature of a working station, the method comprising:

obtaining a desired target temperature of a working space defined in an air box where the working station is located;

obtaining the current temperature of the working space where the working station is located from a temperature detection unit of a system;

controlling a driving assembly of the system to drive a baffle member of the system to cover an opening of the system completely, to cover the opening partially, or to not cover the opening via the difference between the current temperature of the working space detected by the temperature detection unit and the desired target temperature of the working space;

wherein the air box comprises a casing and a first connecting member, the opening is defined in the casing, the first connecting member is coupled to the casing at the opening, a sliding groove is defined in the casing or the first connecting member, the sliding groove communicates with the opening, the baffle member is slidably coupled to the air box at the sliding groove;

the baffle member extending outside of the sliding groove defines a retreating gap, the retreating gap is configured to receive a sidewall of the casing forming the sliding groove or a sidewall of the first connecting member forming the sliding groove.

14. The method according to claim 13, further comprising:

obtaining a current position of a sliding block of the system from a position detection unit of the system;

determining whether the sliding block has moved to one of target positions of the sliding block corresponding to the desired target temperature of the working space according to the current position of the sliding block and the target position of the sliding block, where each of the target positions of the siding block corresponding to one of the target temperature information;

outputting adjustment information to the driving assembly to bring the sliding block to move toward the target position of the sliding block corresponding to the target temperature information continuously according to the current position of the sliding block and the target position of the sliding block if the sliding block has not already moved to the target position of the sliding block.

15. The method according to claim 14, further comprising:

obtaining a current position of the sliding block from the position detection unit again;

determining whether the sliding block has moved to the target position of the sliding block again according to the current position of the sliding block obtained again and the target position of the sliding block;

continuously outputting the adjustment information to the driving assembly and determining whether the sliding block has moved to the target position of the sliding block until the sliding block has moved to the target position of the sliding block, if the sliding block has not already moved to the target position of the sliding block.

16. The method according to claim 14, further comprising:

continuously obtaining the current temperature of the working space where the working station is located from the temperature detection unit and controlling the driving assembly to drive the baffle member via a difference between the current temperature of the working space obtained again and the target temperature of the working space if the sliding block has not moved to the target position of the sliding block.

* * * * *